US007897214B2

(12) United States Patent
Poullos

(10) Patent No.: US 7,897,214 B2
(45) Date of Patent: Mar. 1, 2011

(54) LASER APPLIED MULTIFUNCTIONAL COATINGS FOR MARINE AND AEROSPACE VEHICLES

(75) Inventor: Mark Poullos, Dallas, TX (US)

(73) Assignee: Dunfries Investment Limited, Jersey, Channel Islands (GB)

( * ) Notice: Subject to any disclaimer, the term of this patent is extended or adjusted under 35 U.S.C. 154(b) by 241 days.

(21) Appl. No.: 12/318,424

(22) Filed: Dec. 29, 2008

(65) Prior Publication Data

US 2009/0181180 A1 Jul. 16, 2009

Related U.S. Application Data

(60) Provisional application No. 61/009,157, filed on Dec. 27, 2007.

(51) Int. Cl.
*B05D 1/06* (2006.01)

(52) U.S. Cl. ..... 427/470; 427/202; 427/475; 427/554

(58) Field of Classification Search ..... 427/470, 427/475, 202, 554
See application file for complete search history.

(56) References Cited

U.S. PATENT DOCUMENTS 4,122,211 A * 10/1978 Kikuga et al. ..... 427/461
5,098,771 A * 3/1992 Friend ..... 428/209
2007/0224343 A1* 9/2007 Langlois ..... 427/180

FOREIGN PATENT DOCUMENTS

EP 426 904 A1 * 5/1991

* cited by examiner

*Primary Examiner*—Frederick J Parker
(74) *Attorney, Agent, or Firm*—Welsh Flaxman & Gitler LLC

(57) ABSTRACT

A method of producing a functional layer on a substrate, such as metal would include the steps of applying an electrostatic powder as a primer coat to the substrate, after which the primer is cured by a laser. A conductive layer is then applied and cured to form a functional layer, such as conductive tracings over all or a portion of the substrate.

11 Claims, 9 Drawing Sheets

50: 120 mm field previously coatd
52: 120 mm field being coated
54: 120 mm field to be coated
56: Large metal substrate

LASER APPLIED MULTIFUNCTIONAL COATINGS FOR MARINE AND AEROSPACE VEHICLES

CROSS-REFERENCE TO RELATED APPLICATION

The present invention claims the priority of provisional patent application Ser. No. 61/009,157, filed on Dec. 27, 2007.

FIELD OF THE INVENTION

The present invention is directed to systems and methods for curing resins utilizing lasers.

BACKGROUND OF THE INVENTION

Today, more than ever, the demand on coating performance has increased to where the coating application has become paramount in the operational functioning of the coated structure. In the past, structural coatings were applied as a means to prevent corrosion and increase the aesthetic appearance of the coated structure. The requirements of coating performance are no longer limited to the obvious aesthetic value and corrosion resistance. Today coatings are required to take on a multifunctional role, typically, new coatings are also used to enhance UV resistance, abrasion resistance, and chemical resistance.

Of particular interest to our transportation infrastructure are electrically heated layers covering particular regions of the aircraft's or ship's substrate. In the past, such electrically heated structures were laminated between layers of safety glass or other optically transmissive materials. These heaters (which are used on ships, aircraft, and automobiles) prevent ice buildup and increase visibility by removing condensation. U.S. Pat. No. 6,832,742 describes a system and method for electrical de-icing coating. This patent describes a composite material with an electrical mesh connected to a voltage source; this is to enable the removal of ice buildup on aerospace or other transportation vehicles. This patent describes a method for manufacturing such a composite layer. Also in this patent, is a method described from mechanically affixing the composite layer to a substrate. This is accomplished by using common industrial adhesives.

U.S. Pat. No. 4,737,618 describes a "heating element for a defrost device on a wing structure, such a device and a process for obtaining same". This patent describes electrical resistive elements in a device, such as a wing structure of an aircraft, or the blades of a helicopter, that includes conductive fibers embedded in a composite matrix structure, and power supply wires connected electrically to the said conducting fibers. These include carbon fibers oriented in the shape of a ribbon that are preimpregnated with resin and affixed to a substrate layer. These electrical resistance elements are then soldered to a corresponding power supply.

For many years the buildup of ice on transport vessels and vehicles has long been understood as a persistent problem. In fact, such ice buildup has been a major cause of the loss of life and loss of revenue for transport companies and individuals. Generally speaking, ice buildup occurs in two fashions, rime ice, and clear ice. Rime ice occurs when nearly frozen particles come in contact with the structure that is near, or at, the freezing point. The freezing particles begin to form a buildup of ice on the structure. Rime ice tends to be more detrimental for laminar flow on aircraft, because rime ice is very rough in its nature. Clear ice forms when super cooled water droplets come in contact with a surface that is at, or below, the freezing point. Clear ice is more insidious in nature, because its formation is not easily recognized by visual inspection in-flight. However, the weight produced by clear ice can build up rapidly. This is not only true for aircraft, but for ships as well. The effect of ice accumulation is even worse on rotational components, such as propellers and helicopter rotor blades. De-icing equipment should be activated on these components prior to its accumulation. This means that icing conditions must be anticipated. However, if these conditions are not anticipated and icing is then unexpectedly encountered, a dangerous situation can occur. The application of de-icing equipment at this point can lead to a severe, out of balance condition. This is because current de-icing technology cannot shed equal amounts of ice on opposite sides of the rotating mass. To make this problem even worse, when the ice finally breaks free, it is sent crashing into other structures, sometimes causing severe damage. Different types of devices are known for de-icing in these critical zones on aircraft and ships. The majority of these "critical zone" devices employ electric heating as a means to break the ice free structure. Aircraft often use bleed air from the turbine engine to melt the ice by ducting bleed air in channels beneath the structure. Ships will often employ steam or hot water, in concert with electrical power, to remove ice. An additional technique, to remove accumulated ice is with the use of chemical de-icing agents, such as alcohol and propylene glycol. All the associated techniques are burdened with cost, both monetary and in the performance of the transport body. For example, the typical cost of the de-icing of commercial aircraft is in a range between $1500 and $3000. This is dependent on the size of the aircraft and the locale of the de-icing application. Chemical de-icing can be performed many times a day on a single aircraft, not only is the cost prohibitive, but the impact that these chemicals have on our environment is detrimental as well. Other de-icing techniques are more easily implemented by the ship and aircraft pilot. Even these techniques have their drawbacks. For example, using bleed air off turbine engines reduces available power for the aircraft and also increases the amount of fuel consumed.

Electrical de-icing equipment has many advantages, some of these are: they may be activated by the pilot or operator at will, or they may be controlled by an automatic system, such as a computer programmed device, which will eliminate the human factor in determining when the de-icing system must be activated. Current technology and electrical devices for de-icing consist of a network of resistive wiring elements. This is not unlike what one would find on the rear window defroster in an automobile. Even the state of the art electrical devices have these drawbacks. Metallic wiring elements are generally placed in a rubber matrix that is bonded to the leading edge of a wing, or that of a rotor blade, or propeller. The whole of this device is fragile and has a very short lifespan, especially when operated for significant amounts of time. Repair of this type of device can be very expensive and is not easily accomplished. In fact, when damage becomes apparent, the entire de-icing device is replaced.

Newer and more improved construction techniques are being developed. These generally include a pre-fabricated matrix that consists of the resistive metallic heating elements and a woven fiber support. This is generally covered with a rubberized coating or compatible plastic material. The ends of the metallic heating elements are connected to a suitable power supply. The power supply's electrical current is modulated in a predetermined fashion. A large part of the electrical heating elements are connected in series with each other. Although many of these arrays may be connected in parallel, it still stands to reason that if one element line fails, it will cause the subsequent failure of many sections connected electrically to the failed section. This can be disastrous in the case of a rotating structure, such as a propeller, or a rotor blade. The resulting out of balance condition has, and will cause, the disintegration of the rotating mass. Other factors that detract from current technique include the added mass of the de-icing system, coupled with the fact that they tend to disrupt the airflow around an aerodynamic body.

SUMMARY OF THE INVENTION

This instant invention overcomes the drawbacks of the prior art by employing entirely new techniques for the manufacture and application of functional coatings, such as those that incorporate fouling, corrosion inhibitors, and deicing systems. Furthermore, this new invention overcomes the phenomena of the electrical heating elements burnout by replacing the old style of resistive wire heating elements with a new, more robust, and redundant resistant coating layer matrix. Furthermore, this de-icing system is incorporated in a pigmented layered matrix that is only slightly thicker and heavier than coatings that are already used for corrosion protection or aesthetic reasons. This new technique will greatly enhance the aerodynamics and de-icing capabilities of ships, aircraft, and automobiles. This new invention eliminates many of the troublesome electrical connections found with current technologies. This new de-icing invention is used in place of current polyurethane enamel coatings, such as those used on aircraft, without reducing, or limiting, the coating options available and the aesthetic appearance. This new coating technique is easily adaptable to any profile, including the wing, rotor blade, fuselage, and many other structures, such as ships.

The present invention includes one or more functional layers of radiation curable resins. The radiation curable resins find a particular use in coating compositions for lasers, applied polymer coatings. One functional layer acts as a release agent and is altered topographically to include riblets and aerodynamic surface variations. Another functional layer contains chopped graphite and metallic conductive components to decrease electrical resistance. Still other functional embodiments contain graphite powder and other electrically resistive compounds, such as ferric oxide. Other references that include such functional layers are U.S. Pat. Nos. 6,894,084; 5,977,269; 6,933,051; and 5,324,374.

One of the features of this invention is the application of electrically conductive coating material made from metallic elements and chopped graphite fibers. This is compounded in a low melt CBT (Cyclobutylene Terephthalate) or PBT (polybutylene Terephthalate) resin. CBT and PBT resins are chosen for their excellent wetting characteristics and excellent loading characteristics. These materials also have very good environmental resistance, such as UV, and chemical resistance. These materials are very adaptable to laser cladding and have a low melt temperature.

In fact, another objective of this invention is to describe a means of applying the functional coating layer using laser processing.

Yet another objective of this invention is to provide distinct functional layers at precise areas over the coated surface.

A further objective of this invention is to provide an aesthetically pleasing surface coating that has excellent resistance to UV and environmental agents.

Another objective of this invention is to provide a release coat over the entire coated surface to further enhance the de-icing characteristics of the coated structure.

Another objective of this invention is in conjunction with maritime structures. This objective is accomplished through the careful application of functional coatings allowing an electrical circuit pattern over a substrate. This application is used for the generation of chlorine ions, and other gases, through the process of electrolysis. This application will allow a reactive anti-fouling coating system for ships and marine structures. This application is not unlike similar designs used in the automatic chlorination of swimming pools.

A further objective of this invention is to provide for a circuit design embedded in the functional coating as a bubble generator. The aforementioned bubble generator is designed to produce bubbles in the fluid boundary layer of a ship or marine vessel.

Finally, another objective of this invention is to provide a technique whereupon the functional layers are formed and then coated with an aesthetically pleasing topcoat.

BRIEF DESCRIPTION OF THE DRAWINGS

This invention will be better understood from the description given here/after, by way of example, which is purely indicative and does not limit the scope of the invention, in which.

DETAILED DESCRIPTION OF THE INVENTION

Figure 1:
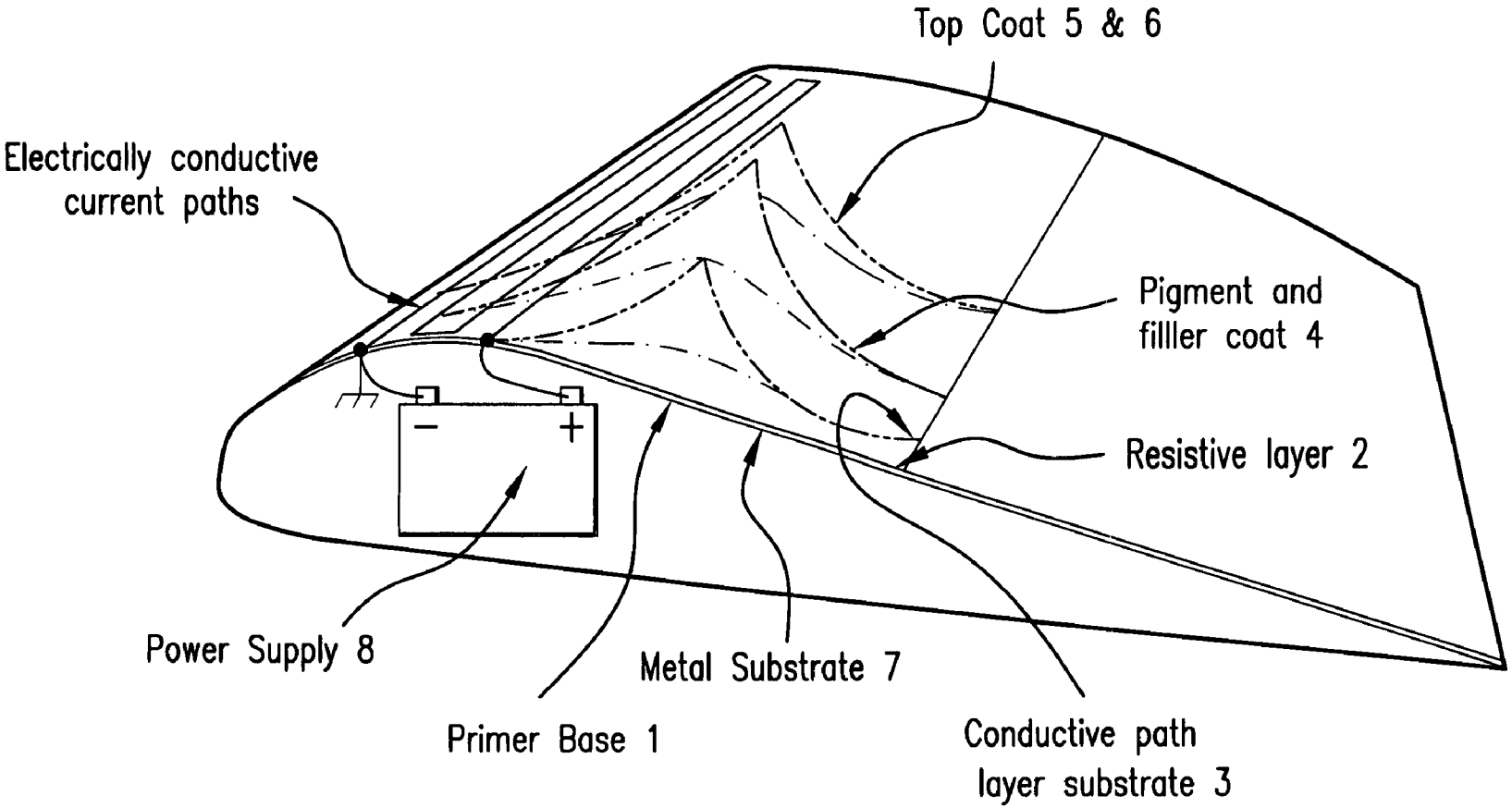
FIG. 1 is a drawing showing a coating layer on a metallic substrate.

FIG. 1 illustrates an edge on view of a coating layer that is built-up upon a substrate 7, such as a wing, or the hull of the ship. This drawing depicts the substrate 7, a primer base 1, a combined resistive layer 2 and a conducting layer 3, pigment and filler layer 4, a multilayer pigmented topcoat 5, and finally a release topcoat 6. Although the present invention is described with respect to a metallic substrate, it is important to note that other substrates, such as composites, fiberglass or graphite can be used. Additionally, the conductive material is made from CBT or PBT.

This view of the coated structure will demonstrate the capacity of the laser system to selectively coat areas with different coating applications. This is similar in nature to photolithography techniques, without the photomask, or the other associated equipment. In this case, the desired powder coating layer is electrostatically applied and fused only in the desired areas with an appropriate laser. These layers include the combined resistive and conductive layer, the pigment layer and the top coat layer. The laser, in this case, can either be a carbon dioxide laser $C0^2$, a solid-state laser, (such as N.

D. YAG.), or a UV laser or diode laser. The laser of choice is dependent upon the relative absorption of the coating material. For polybutylene terephthalate, both a CO2 laser, and ND.YAG lasers are suitable, with diode lasers and infrared lamps for additional thermal assist. The coated material can be precisely applied across the entire structure to be coated. This may include channels of resistive material in necessary areas, such as the leading edge of the wing. One may choose to increase the spacing of the resistive coating elements on surfaces, other than the leading edge to conserve electrical energy.

Also depicted in this drawing are references to the conductive paths created by the multifunctional coating layers, and the connection to a power supply 8 of appropriate capacity. In this drawing the metal substrate 7 is used as a cathode, and the conductive layer. It also depicts the anode and the resistive layer 2, which is used to generate heat through $I^2R$. Losses. The current density necessary to accomplish sufficient heating, varies with the ambient temperature, the thermal conductivity of topcoat, the thickness of the topcoat 7, the thickness of the resistive coat 2, and the accumulation of any ice buildup. This can result in current densities that range between 7.0 milliamp, and 25 milliamps, per square millimeter. Other factors that incur higher current densities include the shape of the aerodynamic structure, whereupon the airflow over the structure results in a pressure drop and a corresponding drop in temperature. This is an adaptation of Boyle's gas law. Although FIG. 1 shows a pigment and filler layer 4, this layer is used only if aesthetic coatings are to be applied.

Figure 2:
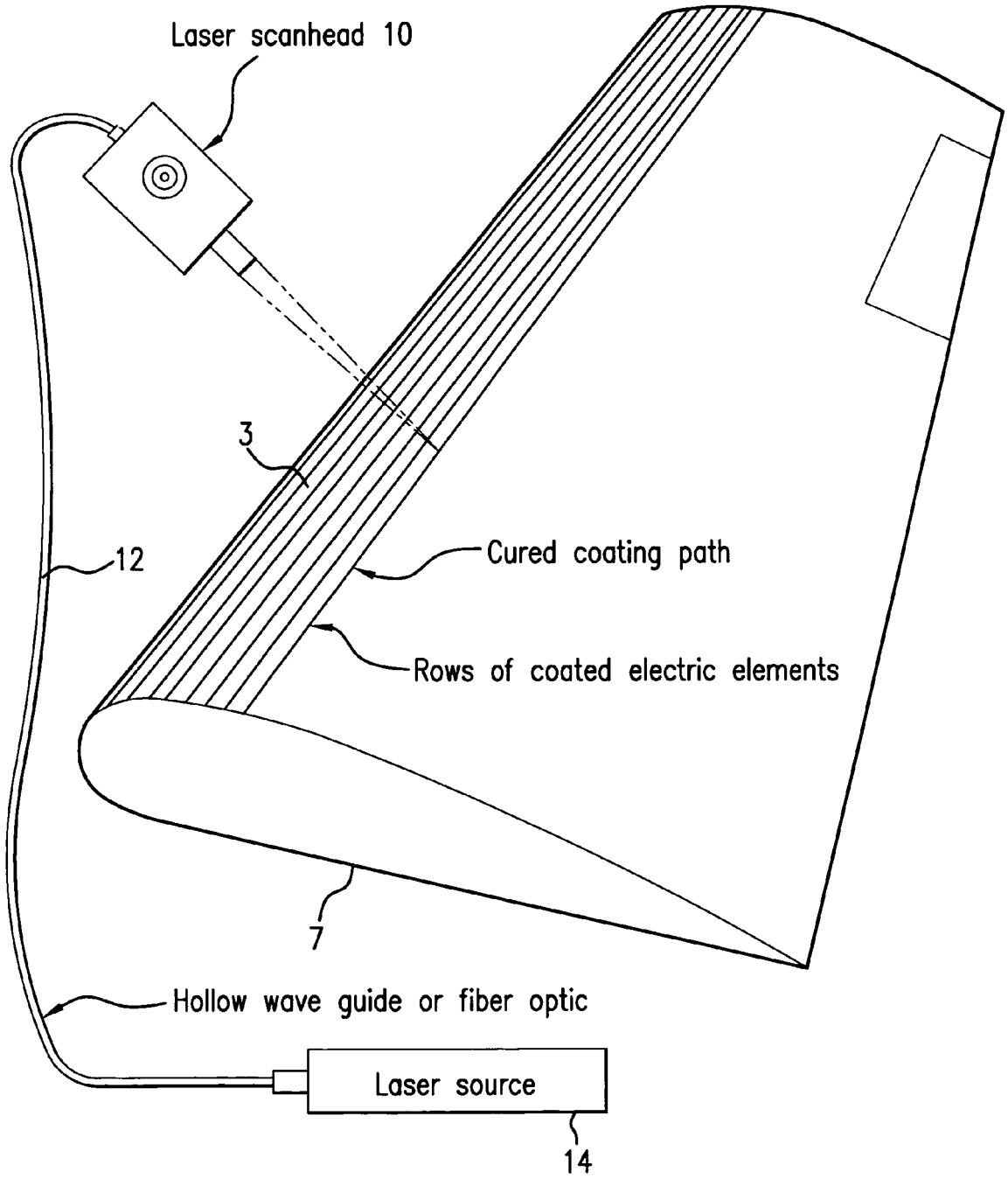
FIG. 2 is a drawing showing a device for coating the metallic structure.

FIG. 2 refers to the positioning of the laser scan head 10 adjacent to the surface 7 to be coated. This demonstrates a means of conveyance to manipulate the laser along the surface of the structure to be coated. The power is delivered to the laser coating head, via fiber optics, or hollow wave guides 12, in the case of a $CO^2$ laser source 14. However, it is noted that other types of laser sources can be used.

Figure 3:
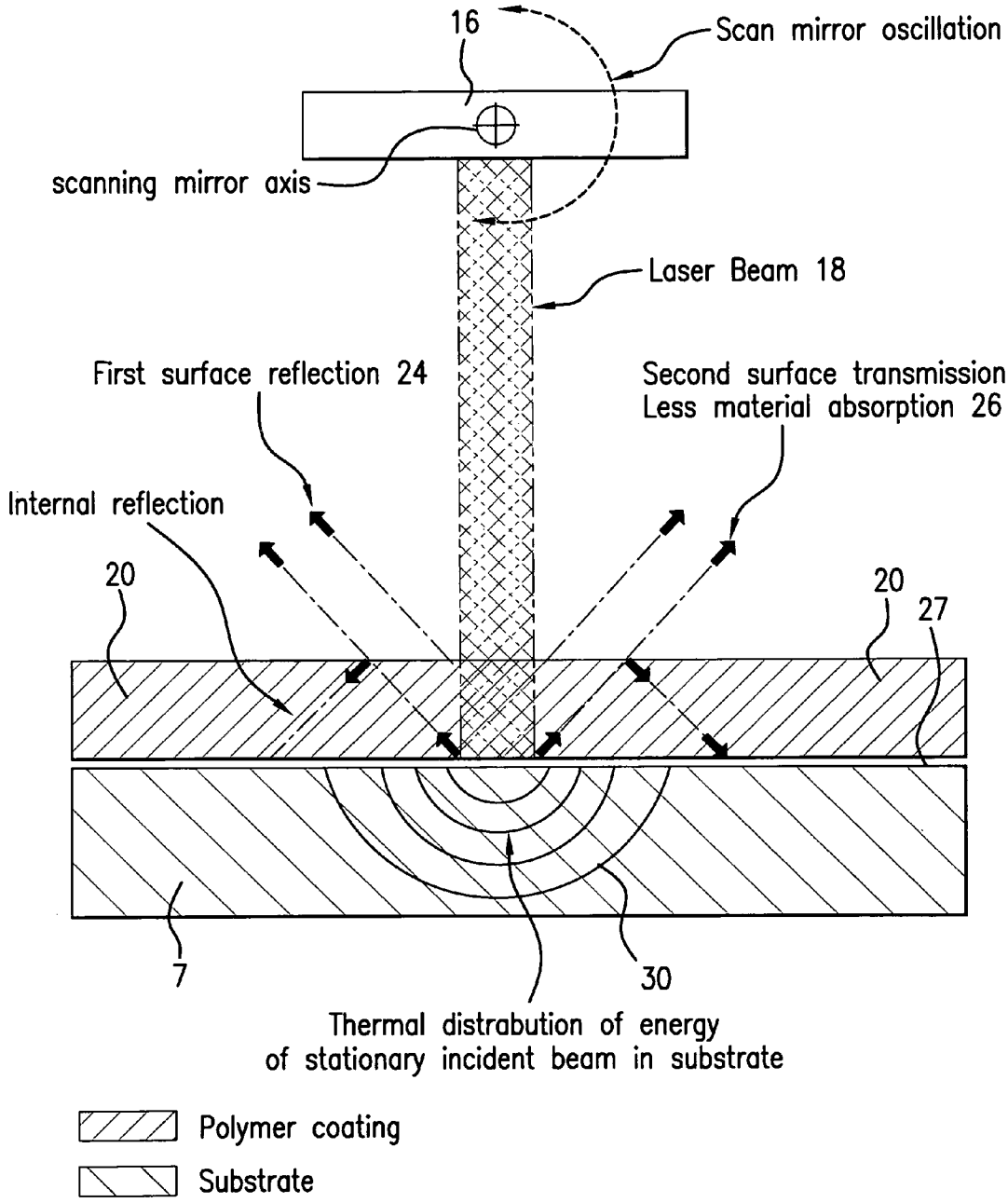
FIG. 3 is a drawing showing the absorption of material on the metallic substrate.

FIG. 3 refers to the absorption by the material of the directed laser energy 18. This drawing also describes the scanning technique employed to cure powder coatings across the entire substrate.

The laser employs a scan mirror oscillation through the use of a scanning mirror 16. This figure shows an interface 22 between the substrate 7 and a polymer layer 20 such as, but not limited to, the resistive layer 2 of FIG. 1. A portion of the beam 18 is reflective from the top surface 28 of the polymer coating 20. A portion of the beam 18 is reflected from interface 22, shown as 26. There is thermal distribution of the laser beam energy in the substrate 7 as shown by 30.

Figure 4:
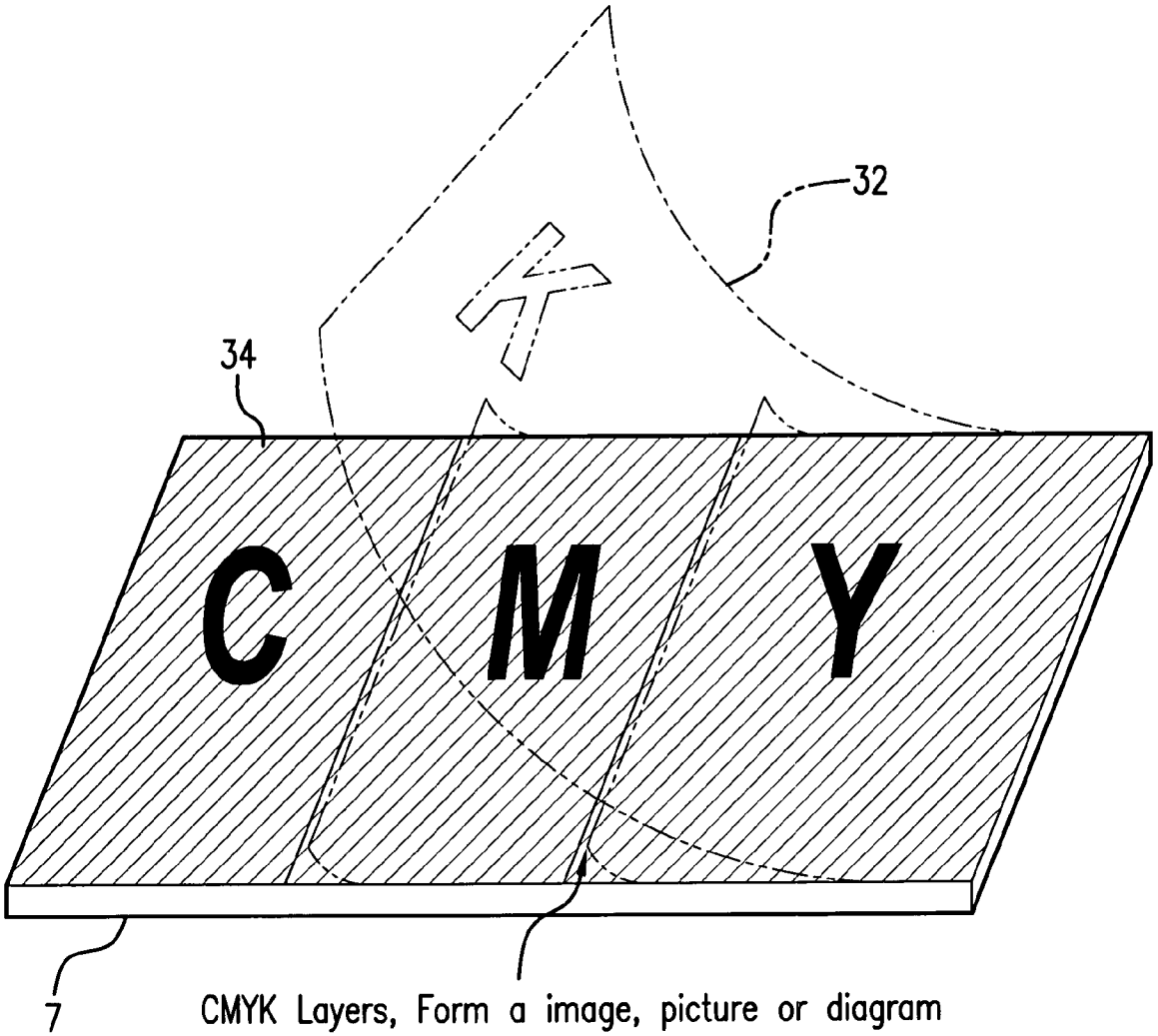
FIG. 4 is a drawing showing the application of a top coat to the metallic substrate.

FIG. 4 refers to the application of the topcoat layers 5 and 6, and a method to produce an aesthetically pleasing coating color, inscription, diagram, image, or photo reproduction. This is accomplished by applying pigmented coating layers in the form of CMYK or RGB 34. First, a particular coating color can be achieved by applying a particular layer of powder coating pigmented with cyan, magenta, yellow, and black. Utilizing a computer interface, the laser selectively coats areas of the substrate 7 with each of the individual pigmented layers of CMYK. The compilation of the entire coated area produces a single color effect, or an image, diagram, or inscription. This process is similar to the function of the inkjet printer, with the exception that it is not limited to the printer size. It does not have to be printed on paper, an ink absorbing sheet, or substrate. Further, the laser must cure, fuse, and cross-link, or in some cases, vaporize the particular coating layer/region. Layer 34 shows that CM and Y have been applied and layer 32 shows that the black layer (K) is being applied.

Figure 5:
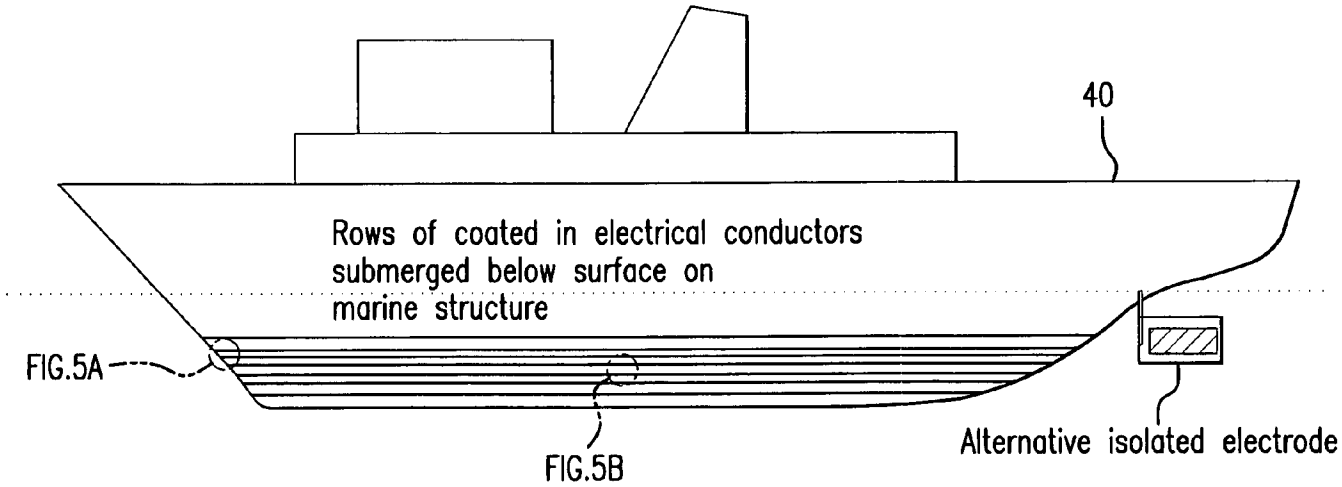
FIG. 5 is a drawing showing the application of an electrolysis layer.
Figure 5B:
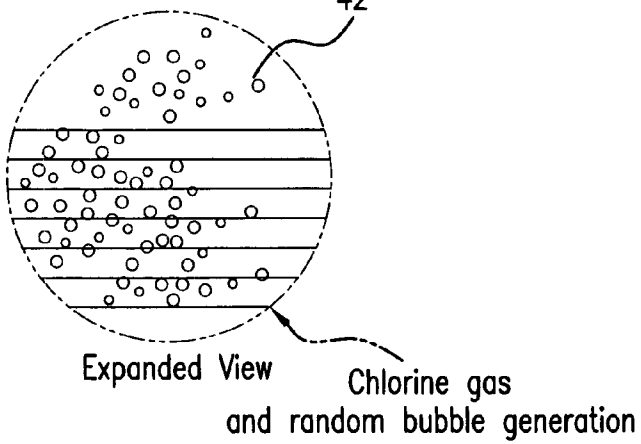
FIGS. 5A and 5B are exploded views of portions of FIG. 5.
Figure 5A:
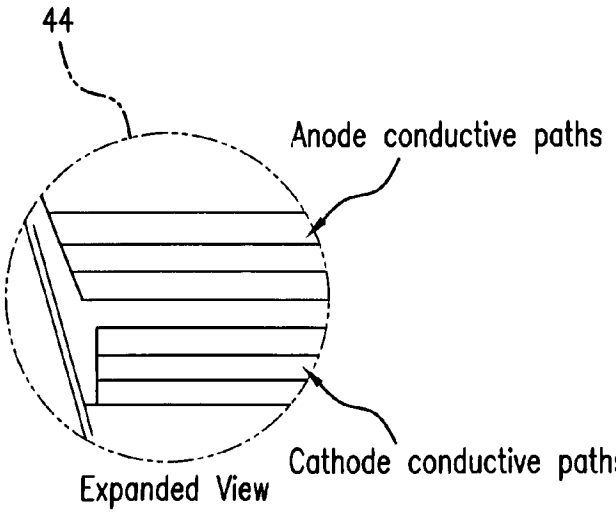

FIG. 5 refers to the application and pattern design of an electrolysis coating layer for the liberation of chlorine ions from a saltwater environment, such as would be provided on a ship. The process of chlorine generation is a well-known art, these processes are described in several patents: these include U.S. Pat. No. 4,085,028 and U.S. Pat. No. 4,119,517. This image also shows the bubble formation of gases 42 liberated by the electrolysis process.

The drawing in FIG. 5 also refers to the application and pattern design of the electrolysis coating layer on the marine structure 40 for the use of a bubble generator. In this application, the bubble generation is used to lessen the viscous flow of fluid in the boundary layer and increase fuel economy.

As previously discussed, the present invention is directed to a method of laser coating that provides a functional coating layer. This technique requires a carefully controlled application of laser energy, sometimes in concert with other thermal energy, such as radiant energy. In this patent application, the background radiation is known as background thermal assist. Background thermal assist is the means by which the substrate temperature is elevated through commonly known techniques. These include preheating by oil bath or radiant energy, such as infrared lamps, arc lamps, or direct heating elements. The advantage of using this technique is that it requires less laser energy to reheat areas that are below the melt temperature. This technique brings the thermal floor of the substrate temperature from ambient to an acceptably high level, at, or below, the cure temperature, or below the melt point. Although the use of background thermal assist decreases the amount of laser power necessary, it is not practical to use this technique in all scenarios. These aforementioned scenarios would include structures with sensitive substrates, such as those found on aircraft, and those substrates and structures where thermal saturation would not be acceptable.

The anode and cathode paths shown in FIG. 5 are produced by the same technique described with respect to FIG. 1 in which a laser would initially be used to heat a powdered resistance coating to the substrate 40 of the ship after the coating has been electrostatically charged and sprayed onto the substrate. The conductive paths are then applied to the resistance coating and a top coating applied over the conductive paths. The laser would be used to cure these layers after they have been sprayed onto the previous layer. When a source of voltage is applied to the conductive paths, such as shown in FIG. 1, chlorine gas is produced which would prevent fouling of the submerged surface 44 of the ship. This is generally needed when the ship is docked and not moving.

Figure 6A:
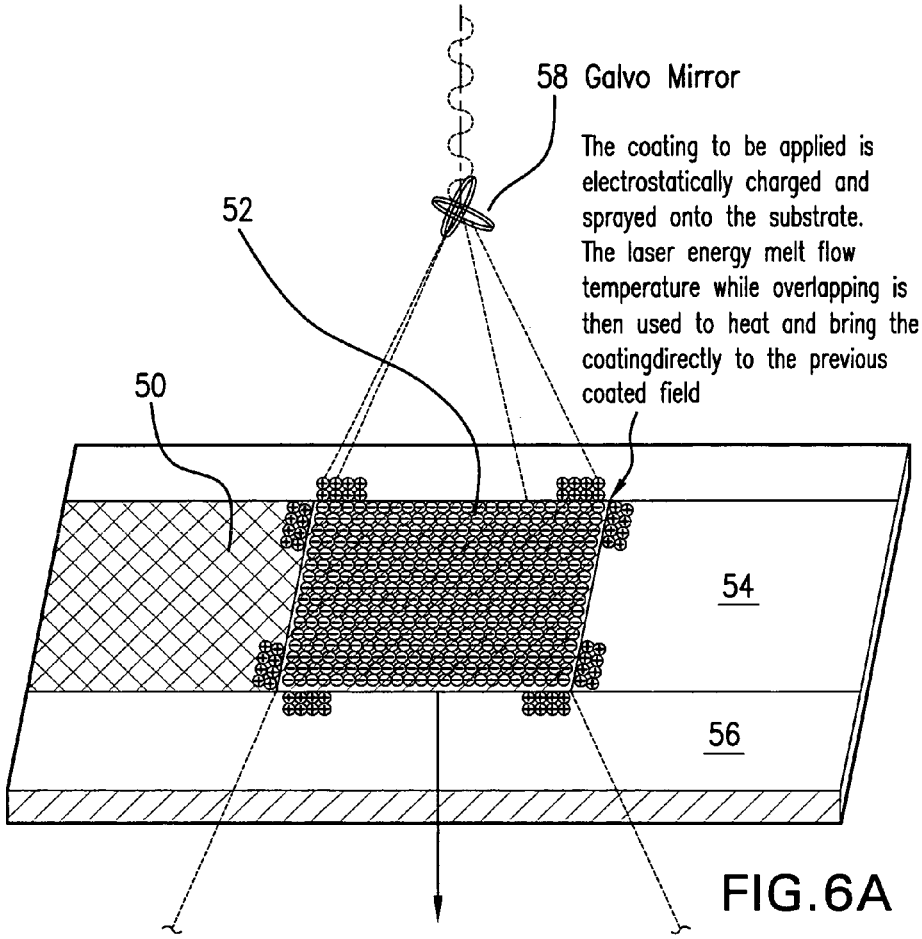
FIGS. 6A and 6B are drawings showing the technique of applying a coating over a substrate.
Figure 6B:
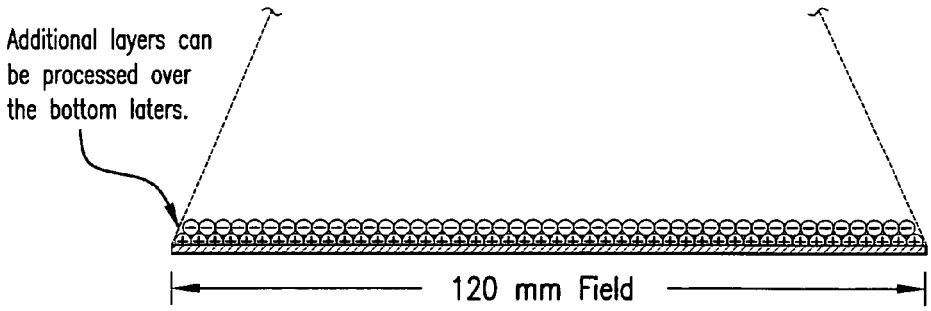

FIG. 6 shows a technique of applying a functional coating over a substrate requires that the laser radiation be applied in an effective and uniform manner. A laser beam is generally directed over the coated surface in a typical raster-scan pattern, also known as push broom pattern. The upper melt temperature is controlled by modulating the rate of scan, laser beam footprint, and laser power modulation. If the size of the object to be coated is too large for the available power of the combined laser and background thermal assist, then the structure to be coated must be segmented into small enough fields that can be thermally managed by the available laser power. This figure shows a section 50 which has been coated and cured as well as a section 52 which is being coated using the galvo mirror 58. Section 54 illustrates the next section to be coated of the large substrate 56. This substrate could be made of metal or other materials. Although sections 50, 52 and 56 are shown to be squares 120 mm in length, it can be appreciated that other sized squares could be employed. The coating produces a uniform smooth, pin-hole free coating. The power required from the laser is dependent upon the absorption of the coating, and the area being processed. The energy is less, but also dependent upon the method of the thermodynamic properties of the substrate. As the coating layer increases in thickness, the properties of the substrate become insignificant. In order to obtain a smooth consistent coating, a technique is heretofore described that integrates the coating fields in a uniform manner.

Figure 7:
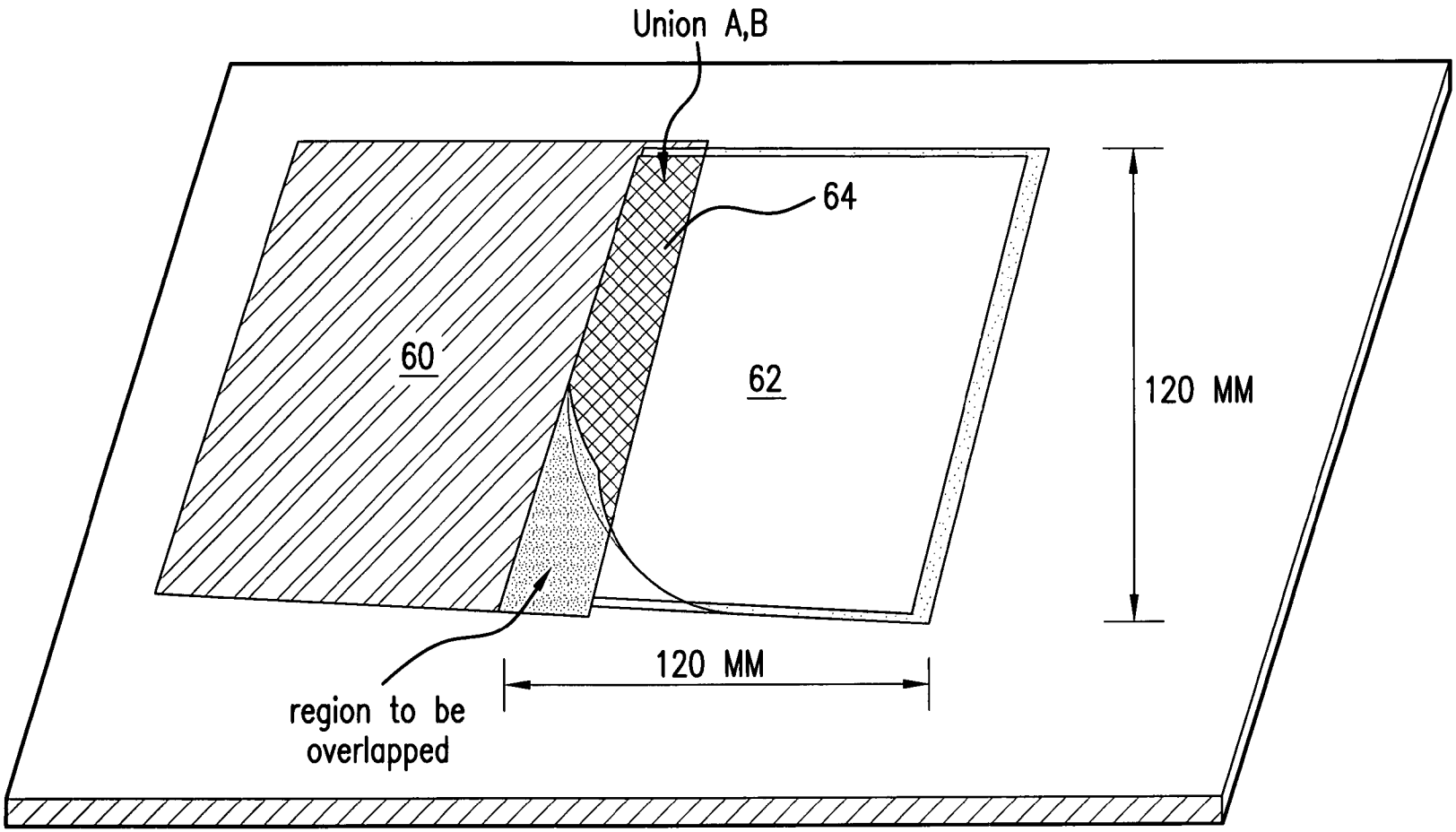
FIG. 7 is a drawing showing a technique for layering adjacent coating fields.

FIG. 7 depicts a technique that is involved for the layering of adjacent coating fields. In the process of laser coating, it is not desirable to join thermal fields, and consequently, coating layers edge to edge with a butt-joint typed fashion. If the coatings are only butt-jointed together a visual disparity between adjoining segments may be noticed. Also, when using this technique, the butt-joint is subject to thermal stress and chemical attack. It is, therefore, desirable to overlap adjoining coating fields in such a manner that the entirety of the coated surface is uniform and consistent.

This is accomplished through the layering of the adjoining fields in an alternating fashion, such that field 60 and field 62 union is overlapped, generally, with multiple coats. Thereupon, the union joint between field at 60 and field 62, can be thermally scanned by laser with a technique that tapers the thermal gradient across overlapped section 64. It is also necessary to maintain coating temperature at and above the melt point during this process. It was found that using high intensity lamps, such as infrared lamps and arc lamps, was sufficient to hold the near field coating melt temperature above the coating melt point. In test, a 2000 watt lamp, with a color temperature of 2300° C. was utilized to maintain the coating and the substrate temperature at, and above, 110° C. over an area of approximately 1 $m^2$. A coating of PBT powder filled with 20% by weight of chopped glass was applied with an electrostatic spray gun over a 0.625 mild steel substrate. The coating thickness was approximately 300 μM.

Temperature measurements of this target were conducted with a Flir thermal imaging camera, and measured temperature disparities of plus, or minus 21° C. were, measured across the target surface. A CO2 laser was utilized to scan the target surface with the power density of 16 W per square millimeter with a beam diameter of 8 mm. The laser power was modulated with a (PWM) technique at an average of 940 Hz. The scan rate was 60 Hz in the X axis, and it was incremented every 2 seconds in the Y axis. The application of laser radiation was able to maintain a uniform target temperature of plus, or minus 5° C., over the entire 1 m squared surface. The upper melt temperature of the coated surface reached 178° C.; this was below the dissolution temperature of 242° C.

This process describes the combination of directed laser energy and high-energy lamps, that improve the melt flow of the coating material and the speed at which the coating is processed. This technique provides the most consistent coating between adjoining fields, and the union of other coating fields, directly adjacent to the primary coating field. This technique also alleviates thermal stress in the coating matrix. Since most polymer coatings have thermal expansion rates far exceeding metallic substrates, it is necessary to provide a means by which the adjoining coating fields are spatially uniform and that thermal expansion of one coated field does not propagate and affect, detrimentally, the union of the next coated field. Alternatively, if it is desirable to butt-joint the coated field, one may choose to rescan the coated field joints and remelt the polymer coating with laser energy. This technique would alleviate the thermal stress on the coated field unions, and cause the union joint to become more uniform and aesthetically pleasing.

Of the foregoing descriptions, it can be seen that there are many diverse applications for laser applied functional coatings. The more salient points of this application are to provide a means to precisely control the coating application. Amongst these points of this process are:

1. Apply coating of desired characteristics.
2. Fuse the applied coating in a desired pattern, or manner, which produces a coating layer with functional properties.
3. Remove the un-fused coating layer areas and reclaim, or recycle, them for later use.
4. Apply a desirable topcoat; this step is optional. Another example of a functional coating is the ability of laser applied coatings to alter the surface topography of a structure, moving through a gas or fluid. An analysis of the aerodynamic and fluid dynamic flow about structure, obviates areas that produce turbulence and drag during certain regimes of normal operation. It is often admitted pages during the coating process to produce surface topography that directly influences the boundary layer, and the flow of a solid body moving through a fluid or a gas. A good analogy of this is the dimples on the golf ball.

Figure 8A:
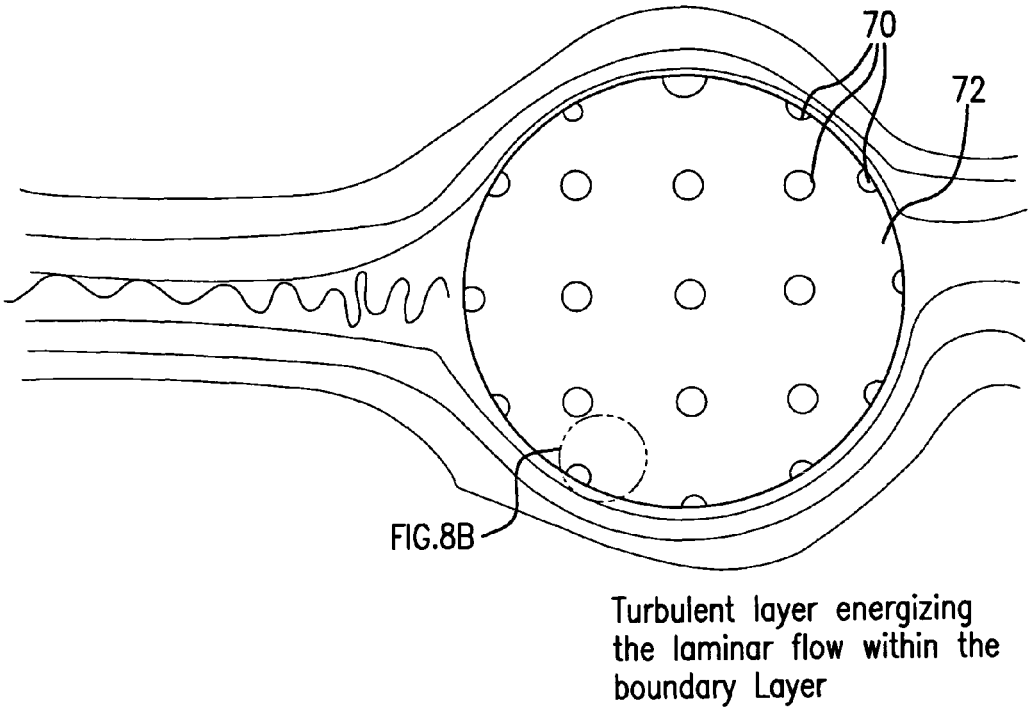
FIGS. 8A and 8B are drawings showing the effect of a coating according to the present invention on a golf ball.
Figure 8B:
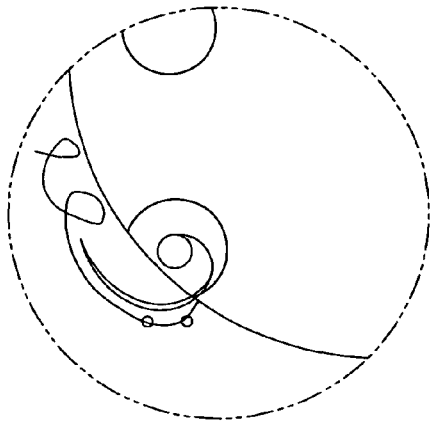

Referring to FIG. 8, the dimples 72 on a golf ball 74 re-energize the turbulent boundary layer and allow the airflow to follow the contour of the golf ball and reduce turbulence in its wake. This technique reduces the pressure difference between the leading edge and the trailing point of the golf ball. The reduced pressure drag on the golf ball allows the golf ball to track more accurately while in flight. The same is true for aerodynamic structures and solid bodies moving through a fluid, such as the ship shown in FIG. 5. It is relatively easy with laser processing to produce boundary layer flow structures. Thermoplastic powder coatings are applied to a solid body in multiple finite layers. A computerized model of a flow structure is stored in the program memory where they are selected at different points on the solid body. At this juncture in the coating process, the laser simply fuses the powder coating on the surface of the solid body. This technique is utilized only in those areas where one wishes to affect the flow dynamics, when advantageous, to produce the desired aerodynamic, or fluid dynamic results. This is accomplished through the buildup of many multiple coats and followed up by fusing with laser energy. Also, the laser power may be focused and direct, in such a manner, as to an ablate the surface to form dimples, or other concave structures in the solid body coating surface. The aforementioned ablation technique has to be performed selectively and carefully, as to not destroy the coated surface directly below the flow structure.

Figure 9:
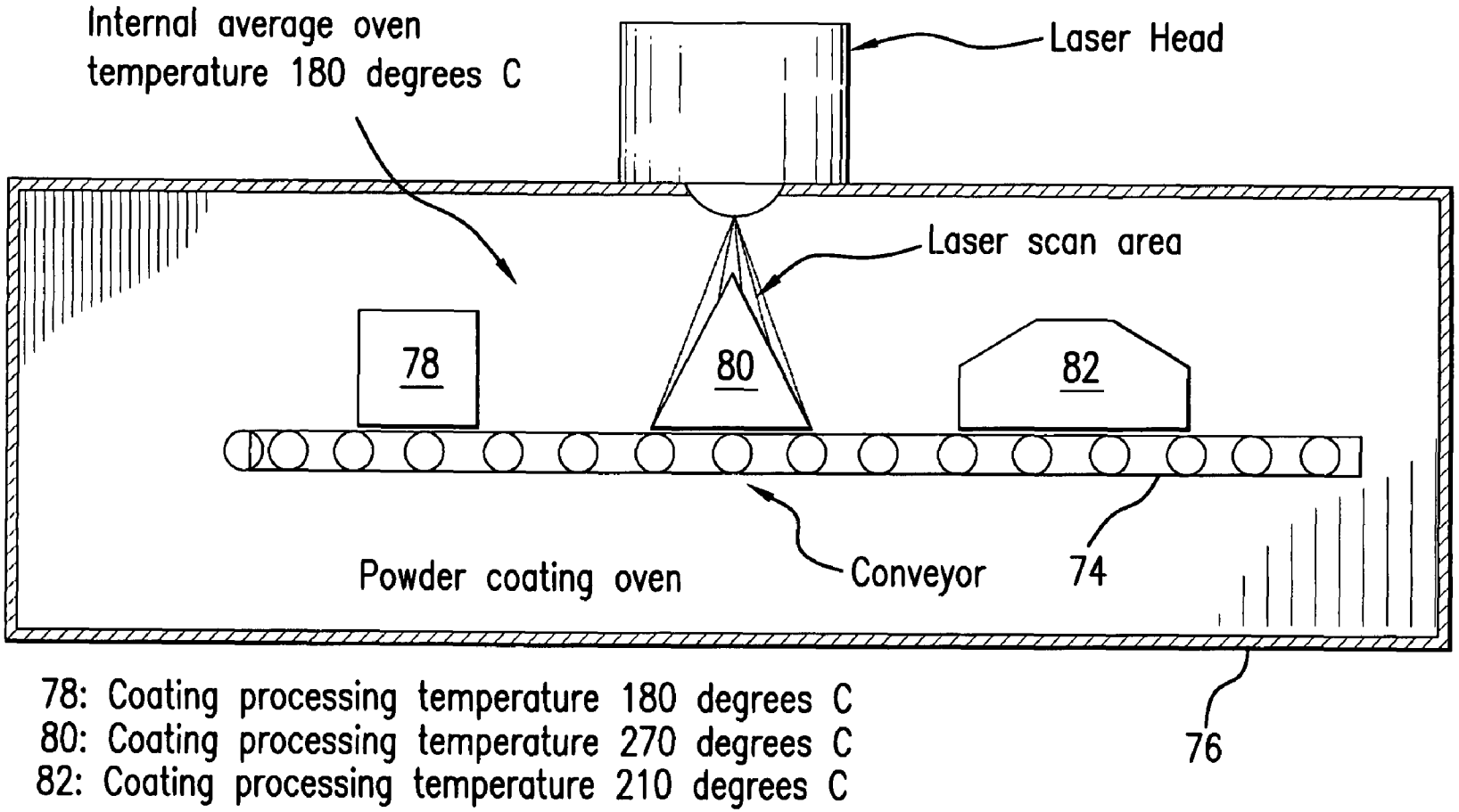
FIG. 9 is a drawing showing a curing oven for coating objects having different curing temperatures.

As shown in FIG. 9, there are applications where the modulation of available coating energy is significant to the end result. For example, with current powder coating technology, the coated object is usually a metallic structure that is first cleaned, primed, and suspended on a conveyor system 74 that is maneuvered through a curing oven 76. Either before entry into the curing oven, or at some other intermediate point, a powder coating is applied with electrostatic spray gun. The coated object continues through the powder coating oven at a predetermined rate that allows the powder coating to fully cure. Unfortunately, this technique only accommodates similar coatings within a very narrow margin of temperature range. Therefore, structures with very large thermal mass or with coatings of large disparity in curing temperature cannot be simultaneously coated. With the current laser coating technique herein described, it is possible to introduce coated articles in the same curing oven with very large disparities in their curing temperatures, just as long as the oven temperature is controlled at, and, below the lowest melt temperature of the coated products. The laser system, at this point, can be used selectively to cure the coated objects 78, 80 and 82 with greatly disparate temperature ranges. This can be done by selecting the coated object along the conveyor coating path, and using laser energy to finish off the cure process. This allows objects with lesser coating temperatures to be processed within the confinement of the curing oven. It is obvious to those skilled in the art, that this will produce a tremendous savings in floor space, energy, oven cost, and production delays.

The methods of the present invention will now be described with respect to several embodiments. In the preferred embodiments there are two examples that are demonstrated. This is done to illustrate the novel applications of this process. These embodiments are applied to 2024-T6 aluminum plates that measure 360 mm in length by 360 mm in width and are 1.52 mm thick. The surfaces were prepared as follows: First, they were cleaned with deionized water, followed by further cleaning with denatured alcohol. After cleaning, the surface was primed with a powder coat primer utilizing an electrostatic sprayer. The primer chosen is manufactured by Solvay Solexis, Inc. The primer number is 6914. A laser scanned field was selected on the metal plate measuring 120 mm in length, by 120 mm in width. The first field position was in the lower left hand corner of the plate designated as position 0,0. The scan field target was scanned in a push broom fashion by a co2 laser whose beam characteristics emitted an infrared radiation at a wavelength of 10.6 μm. Further the beam has a diameter of 8 mm with a power density on the target surface of 16 watts per square mm. The scan was performed across the entirety of the 120 mm square field of the target surface. The rate of scan was a 180 Hz in the "X" direction by 0.3 Hz in the "Y" direction. This scan technique continued for approximately 42 seconds while maintaining a target surface temperature of 227° C. for the best and most uniform melt flow. Power modulation was utilized during this process via a thermal feedback sensor while imaging the target surface to maintain the desired temperature within plus or minus 3° C.

A subsequent 120 mm square target field was then selected by indexing over in the "X" direction and overlapping the first target field by 18 mm to reduce thermal stress. Again, the layer of primer coating was fused using the same technique as mentioned above and repeated until the entirety of the full 360 mm by 360 mm aluminum plate was coated.

After the primer base was applied, the next coating layer was chosen. This coating layer being a conductive layer was a dispersion of PBT powder Poly (Butylene terephthalate) made by the Cyclics Corporation grade CBT 160 ground to a 20 μm powder. This powder was filled with 65% graphite by volume and a combination of 2.5% bismuth and 2.5% lead powders. This dispersion was applied with an ordinary spray gun at approximately 1.2 mm thick and left to dry. Once dry, a target selection field of 120 mm by 120 mm square was positioned in the lower left corner at station 0,0. This initial target area was scanned by a co2 laser as before with a beam diameter of 8 mm and a power density of 12 watts. The scan in "X" direction on the target surface was accomplished at a rate of 240 Hz and in the "Y" direction of 0.3 Hz. Again the laser power was being modulated to maintain a melt temperature of 260° C. for a period of 39 seconds over the entirety of the surface of the target field. Once the coating film was sufficiently formed, the laser target field was subsequently indexed over to the next adjacent target field while still overlapping the first field by 8 mm in the "X" direction. This process was continued over the entirety of the aluminum target until it was uniformly coated with a semi-conductive graphite polymer compound.

The next step in producing the desired coating is accomplished by the ablation of the unnecessary elements of the conductive coating layer. The desired result would be to leave in place a plurality of conductive traces remaining on the coated aluminum target surface. This said ablation to obtain the conductive coating traces is through the utilization of a 90 watt YAG laser emitting radiation at the 532 nm wavelength. The described laser was operated in superpulsed mode with the initial beam diameter of 6 mm reduced to 4 mm on the target surface. This yielded at a power density of 5 joules per square mm with a pulse duration of 90 ns. The entirety of the total aluminum coated surface while being indexed in the "Y" direction of 4 mm then again to 6 mm in the "Y" direction in the following pass leaving a 2 mm thick conductive coating layer untouched. Further, the laser was only allowed to scan for 340 mm in the "X" direction starting from 10 mm in the "X" direction of the far left side of the target. This was repeated until the top surface of the target was reached, thereby leaving a plurality of 2 mm wide graphite polymer traces terminated on both sides of the left and the right with a 10 mm wide by 360 mm tall anode and cathode column. These columns act to provide two common terminals on both sides of the target coating to facilitate conductive current paths for the power supplies.

The next step is the application of a thin protective topcoat. The topcoat is composed of PVDF-HFP (polyvinylidene hexafluoropropene). This protective topcoat layer is a powder coat material of approximately 10 μm or roughly 1250 mesh grain size so that the thickness can be controlled by applying multiple fine layers. This coating is cured by the use of a co2 laser with a 8 mm beam diameter and a power density of 11 watts per square mm. The scan rate was approximately 180 Hz in the "X" direction and 0.2 Hz in the "Y" direction. This is to cover the entirety of the 120 mm by 120 mm field. As before, the power is modulated to maintain a 120° C. or 248° F. uniformly over the chosen target field. A further three more layers were electrostatically applied during the process utilizing a hot flocking technique where the powder coating was introduced to the target surface that is at or above the melt temperature of the desired powder coating selected. This technique is utilized so that when the electrostatically applied powder first comes in contact with the hot surface of the target it will stick and melt in a very short period of time, thereby conserving energy and decomposition of the polymer by limiting the time the polymer is at is actual melt temperature. The target field is then indexed in the "X" direction such that the entire 120 mm by 120 mm field overlaps the first target 8 mm by 8 mm thereby decreasing thermal stress on the adjacent polymer. The final topcoat thickness is 0.30 mm thick.

To complete this multifunctional coating layer, a power suitable power supply 8 is connected to the anode and cathode of the coated target substrate. A voltage of 72 volts in impressed between the anode and the cathode of the coated substrate material with a current of 3.5 amps yielding a power dissipation of 250 watts of electrical energy. The aforementioned 250 watts of power is uniformly distributed over the full 360 mm by 360 mm target surface causing it to warm rapidly. Very high temperatures can be achieved and must be moderated to prevent overheating of the polymer coating.

As mentioned earlier, the second multifunctional coating is nearly identical to the first with only three exceptions. The second applied graphite/PBT coating is further compounded with additional 2.5% by weight copper powder that has a grain size of 25 μm in diameter or approximately 625 mesh. This is added to handle the higher impulse current/energy of the conductive layer in this particular multifunctional coating. The second alteration is that every other or even number horizontal 2 mm electrode is severed with the YAG laser over the entirety of last 6 mm directly adjacent to the anode on the left side. Further, every odd number horizontal 2 mm electrode is ablated over the entirety of 6 mm from the cathode on the right side. This technique is such that the anode segments and associated horizontal electrodes are isolated from the cathode and its associated horizontal electrodes. This is such that the only way the current may be exchanged between the anode and cathode components is through a conductive solution in the very near proximity to the coated surface. The aforementioned conductive solution is preferably salt water wherein the concentration of salt is 3.5% or approximately 35 grams of dissolved salt per kilogram of water. A power supply is connected in the same fashion as in FIG. 1. This power supply differs from the first as in a one kv pulse is impressed between the anode and the cathode with 30 μA of current. This pulse is 120 ms long. The current across the anode and the cathode is periodically reversed every 30 seconds to inhibit the formation of salt compounds. The aforementioned impressed current caused electrolysis in the salt water. The electric current liberates chlorine gas and other gases in the water. These gases form acids such as hydrochloric and hydrofluoric that destroy biofilms on waterborne structures. Another feature of this technique is that these gases and acids quickly dissipitate as to not affect the surrounding body of water. This application is especially useful in light of the continuing environmental problems associated with antifouling coatings on ships and other marine structures.

The descriptions given here are only by way of example and should be by no way construed as to limit the scope of the invention.

What is claimed is:

1. A method of applying a functional layer to a substrate, comprising the steps of:

a) spraying an electrostatic powdered primer coat resin onto the surface of the substrate;

b) curing said powdered primer coat;

c) spraying a powdered conductive layer onto said cured powdered primer coat; and d) curing said powdered conductive layer;

e) spraying an electrostatic powdered top coat layer onto said cured conductive layer;

f) curing said powdered top coat layer;

wherein said cured powdered conductive layer is in the form of conductive traces over the surface of the substrate.

2. The method in accordance with claim 1, wherein said curing steps b), d) and f) are performed by laser scanning.

3. The method in accordance with claim 2, consisting of the steps of:

g) dividing the substrate in a plurality of sections covering the entire surface of the substrate;

h) scanning a first set of said plurality of sections with said laser during said curing step b) over the entire surface of said first plurality of sections;

i) scanning, in a sequential manner with said laser, all of the remaining sections of said plurality of sections during curing step b);

j) scanning said first set of said plurality of sections with said laser during curing step d);

k) scanning, in a sequential manner with said laser, all of the remaining sections of said plurality of sections during curing step d);

l) scanning said first set of said plurality of sections with said laser during curing step f); and m) scanning, in a sequential manner with said laser, all of the remaining sections of said plurality of sections during curing step f).

4. The method in accordance with claim 3, further including the step of tapering the thermal gradient between adjacent sections of said plurality of sections during curing steps b), d) and f).

5. The method in accordance with claim 4, further including the step of maintaining the curing temperature at or above the melt temperature of the various coats between adjacent sections of said plurality of sections by utilizing high intensity lamps.

6. The method in accordance with claim 1, further including the step of applying at least a pigment layer between said top coat layer and said conductive layer.

7. The method in accordance with claim 1, wherein the substrate is metallic and further including the step of connecting a power source between said metallic substrate and said conductive traces to produce a de-icing device.

8. The method in accordance with claim 1, wherein the substrate is the metallic surface of a ship's hull and further including the steps of connecting a power source between said metallic substrate and said conductive traces to produce a device for providing chlorine bubbles used to cleanse said metallic substrate.

9. The method in accordance with claim 1, wherein said powdered conductive layer includes PBT and graphite.

10. The method in accordance with claim 1, wherein said graphite is 65% by volume of said powdered conductive layer.

11. The method in accordance with claim 10, wherein said powdered conductive layer includes 2.5% by weight of copper.

* * * * *